US007456586B2

(12) United States Patent
Morejon

(10) Patent No.: US 7,456,586 B2
(45) Date of Patent: Nov. 25, 2008

(54) VOLTAGE CONTROLLED LIGHT SOURCE AND IMAGE PRESENTATION DEVICE USING THE SAME

(75) Inventor: Israel J. Morejon, Tampa, FL (US)

(73) Assignee: Jabil Circuit, Inc., St. Petersburg, FL (US)

( * ) Notice: Subject to any disclaimer, the term of this patent is extended or adjusted under 35 U.S.C. 154(b) by 327 days.

(21) Appl. No.: 11/343,331

(22) Filed: Jan. 31, 2006

(65) Prior Publication Data

US 2007/0176183 A1 Aug. 2, 2007

(51) Int. Cl.
*H05B 41/16* (2006.01)

(52) U.S. Cl. ..... 315/247; 315/246; 315/200 A; 315/308; 315/291

(58) Field of Classification Search ..... 315/291, 315/307–311, 224, 225, 209, 247, 200 A, 315/185 S, 246
See application file for complete search history.

(56) References Cited

U.S. PATENT DOCUMENTS 4,160,934 A 7/1979 Kirsch
4,987,348 A * 1/1991 Wong ..... 315/307
5,025,204 A 6/1991 Su
6,097,360 A 8/2000 Holloman
6,954,039 B2 10/2005 Lin et al.
7,061,394 B2 * 6/2006 Biebl ..... 340/815.45
2002/0140380 A1 * 10/2002 Biebl ..... 315/291
2007/0159421 A1 * 7/2007 Peker et al. ..... 345/82

* cited by examiner

*Primary Examiner*—Tuyet Vo
(74) *Attorney, Agent, or Firm*—Price Heneveld Cooper DeWitt & Litton LLP

(57) ABSTRACT

A device (300) includes a driver circuit (200) having a field effect transistor (FET) (30), acting as a current sink, a current sense network (10), an operational amplifier (opamp) (20), and a light emitting diode (LED) (40). Current sense network (10) is connected to the source electrode (32) of FET (30), as well as to the inverting input terminal (22) of opamp (20). The non-inverting input terminal (24) of opamp (20) is coupled to a variable voltage control signal source (VDAC) (110). The output terminal (26) of opamp (20) is coupled to the gate electrode (36) of FET (30). LED (40) is connected to the drain electrode (34) of FET (30). The brightness of LED (40) is controlled by varying the amplitude of the VDAC control signal, and on/off status is controlled by a switch S1 disposed between the output terminal (26) of opamp (20) and the FET (30).

22 Claims, 3 Drawing Sheets

VOLTAGE CONTROLLED LIGHT SOURCE AND IMAGE PRESENTATION DEVICE USING THE SAME

1. FIELD OF THE INVENTION

This present invention relates generally to image presentation devices, and particularly, to devices that utilize electronic driver circuits to control the operation of a light source, such as a light emitting diode.

2. BACKGROUND OF THE INVENTION

Current drive and current control devices are well known in the art. Such devices operate to maintain a given magnitude of current along a particular current path for the purpose of stabilizing the operating current ($i_D$) delivered to a respective load. One use for such devices is to provide stabilized current to a light emitting diode (LED). As will be appreciated by those skilled in the art, the brightness of an LED is as a function of the amount of current passing through the LED. To stabilize the brightness of an LED, one must stabilize the current passing through the LED. Prior art patents in the field of current control and stabilized LED operation include U.S. Pat. No. 4,160,934 issued Jul. 10, 1979 to Kirsch; U.S. Pat. No. 5,025,204 issued Jun. 18, 1991 to Su; U.S. Pat. No. 6,097,360 issued Aug. 1, 2000 to Holloman; and U.S. Pat. No. 6,954,039 issued Oct. 11, 2005 to Lin et al.

While stabilized current control in support of LED operation is a laudable pursuit, many current applications require dynamic brightness control for individual LEDs and/or LED arrays. One such application is an optical light engine using LEDs in support of a digital micro-mirror device (DMD) image projection system. In such LED based image projection systems, it is often desirable and frequently necessary to dynamically adjust the individual brightness of one or a plurality of high power LEDs used as projector light sources. LED drive circuits designed to provide stable and/or static brightness control fall short of producing a wide dynamic range of LED brightness control. Therefore, the need exists for LED drive circuitry that permits selective and dynamic LED brightness control. Furthermore, there is a need to provide brightness control circuits that offer advantages in compactness, simplicity, low cost, and speed of operation.

3. BRIEF DESCRIPTION OF DRAWINGS

The above and other features and advantages of the invention will be further understood from the following description of the preferred embodiments thereof, taken in conjunction with the accompanying drawings.

4. DETAILED DESCRIPTION OF A PREFERRED EMBODIMENT

The present description is directed in particular to elements forming part of, or cooperating more directly with, apparatus in accordance with the invention. As will be understood by those familiar with the art, aspects of the invention may be embodied in other specific forms without departing from the scope of the invention as a whole. Accordingly, the disclosures and descriptions herein are intended to be illustrative, but not limiting, of the scope of the invention which is set forth in the following claims.

Figure 1:
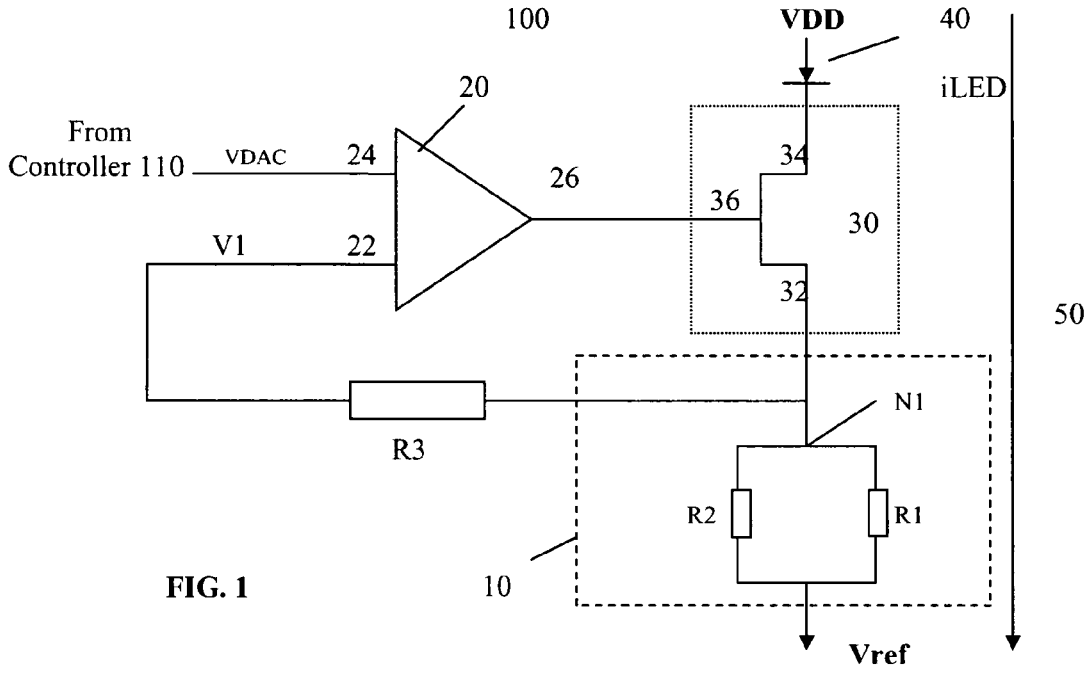
FIG. 1 is a block diagram illustrating a voltage controlled LED having brightness control in accordance with a preferred embodiment of the invention.

FIG. 1 is a schematic diagram illustration of a voltage controlled light emitting diode (VCLED) 100 having brightness control in accordance with a preferred embodiment of the present invention. The VCLED 100 includes a field effect transistor (FET), acting as a current sink 30, a current sense network 10, operational amplifier 20, and at least one light emitting diode (LED) 40. Of note, FET 30 is an N-type FET that utilizes N-channel MOS semiconductor manufacturing technology, as opposed to other semiconductor manufacturing techniques, such as, for example P-channel construction. As is known, the magnitude of current ($i_{LED}$) passing through LED 40 determines the brightness at which the device will operate. By selectively altering the current ($i_{LED}$) passing through LED 40, one can dynamically control the brightness of its operation. The higher the magnitude of current ($i_{LED}$) passing through LED 40, the brighter the device will illuminate.

With reference to FIG. 1, the operational amplifier 20 includes inverting 22 and non-inverting 24 input terminals. Resistors R1 and R2 couple in parallel to provide a current sense network 10. The point of interconnection or node (N1) between resistors R1 and R2 couples through resistor R3 to the inverting input terminal 22 of operational amplifier 20. Node (N1) also connects to the source electrode 32 of FET 30. In response to receipt of current passing through source electrode 32, current sense network 10 will provide a voltage response V1 to the inverting input terminal 22 of amplifier 20. The non-inverting input terminal 24 of operational amplifier 20 is advantageously connected to a variable voltage signal source (not shown) capable of producing a variable voltage control signal VDAC. In accordance with the preferred embodiment, VDAC has a dynamic and variable voltage range that is selectable and most advantageously programmable for use with high speed applications, such as, for example, motion picture image projection systems. Thus, non-inverting input terminal 24 of operational amplifier 20 receives a control signal that exhibits variable magnitude. Output terminal 26 of amplifier 20 drives gate electrode 36 of FET 30. As such, FET 30 operates as a voltage controlled current sink. The anode of LED 40 connects to supply voltage VDD, and the cathode of LED 40 connects to drain electrode 34 of FET 30.

A current path 50 between supply voltage VDD and reference voltage Vref exists along the series combination of forward biased diode 40, terminals 32 and 34 of FET 30, and the current sense network 10. The resistance of current path 50 is a function of the current sense network 10 plus the drain to source resistance of FET 30. Because transistor 30 acts as a voltage controlled current sink, its resistance is determined by the voltage present at output terminal 26 of amplifier 20. The resistance of path 50, and particularly that of FET 30 varies in accordance with the output of amplifier 20. With reference to an assumed and substantially fixed value for supply voltage VDD, the lower the resistance of current path 50, the higher the magnitude of current ($i_{LED}$) passing through LED 40, thus the brighter LED 40 will illuminate. Conversely, the higher the resistance of current path 50, the lower the magnitude of current ($i_{LED}$) passing through LED 40, resulting in reduced illumination.

In response to receipt of current passing through source electrode 32, current sense network 10 will provide a voltage response V1 to the inverting input terminal 22 of amplifier 20.

As will be appreciated by those skilled in the art, the $V_1$ response of current sense network 10 may be readily associated with that current ($i_{LED}$) passing through LED 40. As such, the $V_1$ response of current sense network 10 can be used as one means of estimating the magnitude of current flow ($i_{LED}$) passing through LED 40. Said another way, for each $V_1$ response, there is an associated magnitude of current ($i_{LED}$) passing through LED 40, and a corresponding measure of LED 40 brightness resulting as a function of that current magnitude.

As previously mentioned, the non-inverting input terminal 24 of amplifier 20 is connected to a variable voltage signal source (not shown) capable of producing a variable voltage control signal VDAC. During operation, amplifier 20, acting as a difference amplifier, compares the magnitude of voltage $V_1$ with that of VDAC. When the signals compare, the output 26 of amplifier 20 remains constant, the $V_1$ response remains constant, and the brightness of LED 40 remains substantially unchanged.

When an increase in LED 40 brightness is desired, the variable voltage signal source will issue an increase in the magnitude of control signal VDAC, as applied to the non-inverting input terminal 24 of amplifier 20. In response, the voltage at output terminal 26 of amplifier 20 will increase. When applied to gate electrode 36, the voltage increase will operate to turn-on FET 30. In further response, the resistance of FET 30 will decrease, while the magnitude of current ($i_{LED}$) passing through LED 40 will increase. As a function of the increase in current ($i_{LED}$) passing through LED 40, LED 40 brightness will increase. Due to the high gain of amplifier 20 and a feedback network coupled between source electrode 32 of FET 30 and inverting input terminal 22 of amplifier 20, amplifier 20 will continue to drive the gate electrode 36 of FET 30 until the magnitude of voltage response $V_1$ and the magnitude of control signal VDAC are substantially the same.

Figure 3:
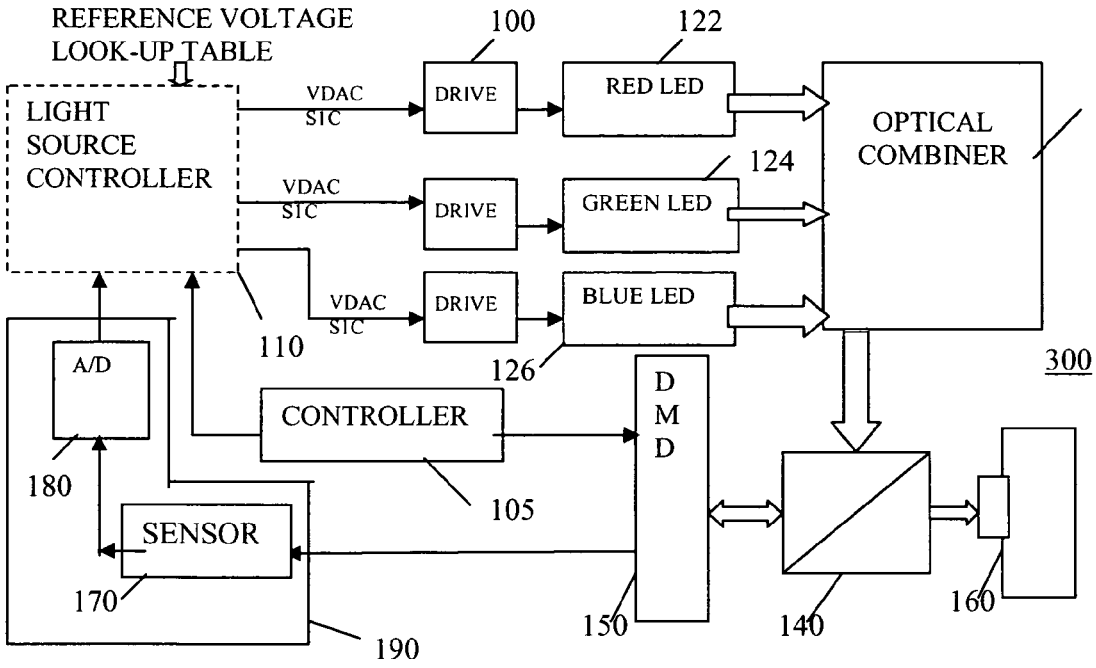
FIG. 3 is a diagram showing a digital micro-mirror (DMD) based image presentation device that utilizes the drive circuitry of FIG. 1 and FIG. 2, respectively.

When a decrease in LED 40 brightness is desired, the variable voltage signal source described in association with FIG. 3, will issue a decrease in the magnitude of control signal VDAC, as applied to the non-inverting input terminal 24 of amplifier 20. In response, the voltage at output terminal 26 of amplifier 20 will decrease. When applied to gate electrode 36, the voltage decrease will operate to turn-down FET 30. In further response, the resistance of FET 30 will increase, while the magnitude of current ($i_{LED}$) passing through LED 40 will decrease. As a function of reduced current ($i_{LED}$) passing through LED 40, LED 40 brightness will decrease. Due to the high gain of amplifier 20 and adoption of a feedback network that is coupled between source 32 and gate 36 electrodes of FET 30, said feedback network inclusive of amplifier 20, as adapted to continuously receive control signal VDAC from the variable voltage signal source; amplifier 20 will once again continue to drive the gate electrode 36 of FET 30 until the magnitude of voltage response $V_1$ and the magnitude of control signal VDAC are substantially the same. In this manner, the VCLED, in accordance with the present invention, operates to dynamically select and adjust the brightness of LED 40 both as a function of the magnitude of control signal VDAC and also as a function of the magnitude of the current ($i_{LED}$) passing through LED 40. These relationships exist, in part, because the control signal VDAC magnitude and current ($i_{LED}$) passing through LED 40 exhibit a linear relationship.

The utility of the present invention is evident in a high current installation having a supply voltage VDD, e.g., 12 volts, and voltage drop across LED 40, e.g., 4.7 volts. For a desired brightness characterized by current ($i_{LED}$) on the order of 10 amps, resistors R1, R2 and R3 can be 0.02, 0.02 and 1 K ohms, establishing a voltage response $V_1$ at approximately 100 millivolts. This is achieved by way of applying a control signal input VDAC of approximately 100 millivolts on the non-inverting input terminal 24 of amplifier 20. Unlike those prior art references that teach a single desired value of current ($i_{LED}$) passing through an LED for purposes of establishing a constant LED brightness, the VCLED 100 of the present invention anticipates variable brightness control for LED 40. As such, the control signal input VDAC from the variable voltage signal source is capable of establishing a full and dynamic range of brightness responses from LED 40. A representative sample of typical responses for a particular LED may be seen with reference to Table 1.

TABLE 1

| VDAC | $V_1$ | $i_{LED}$ | LED response |
|---|---|---|---|
| 20 mV | 20 mV | 2 Amps | 66 Lumens/$m^2$ |
| 80 mV | 80 mV | 8 Amps | 163 Lumens/$m^2$ |
| 180 mV | 180 mV | 18 Amps | 252 Lumens/$m^2$ |

Figure 2:
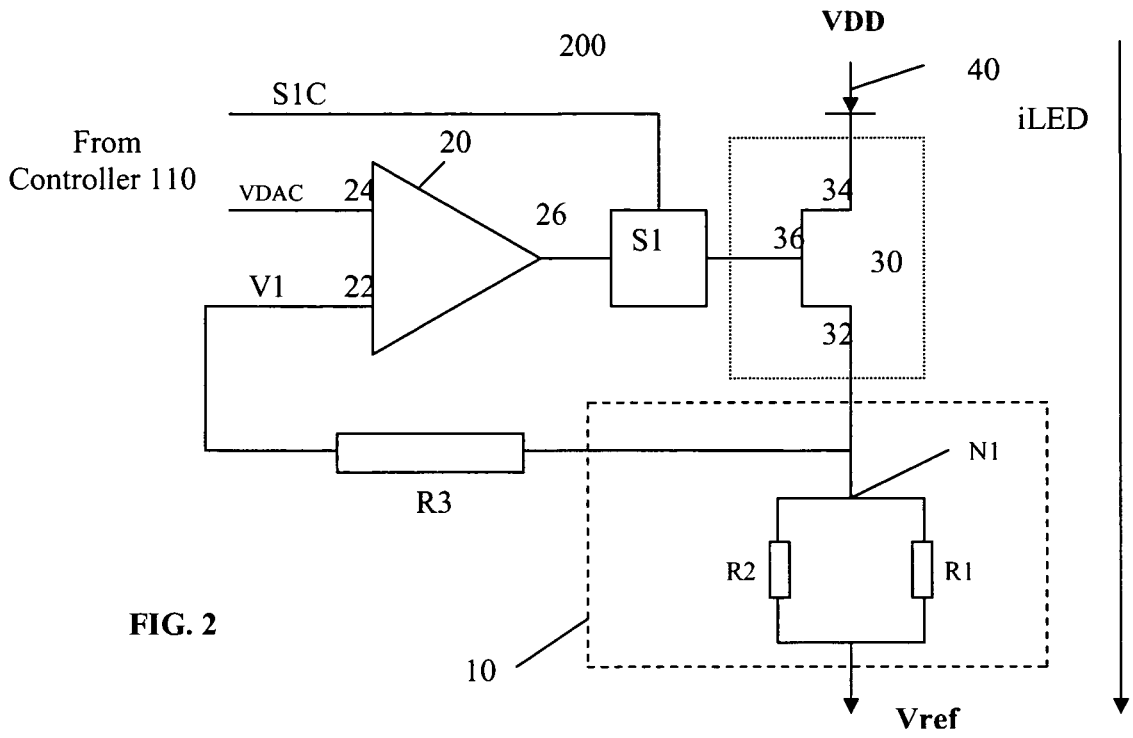
FIG. 2 is a block diagram illustrating an alternate voltage controlled LED having brightness control.

FIG. 2 is a schematic diagram illustrating an alternate embodiment of a voltage controlled light emitting diode (VCLED) having brightness control. The VCLED 200 of FIG. 2 includes a field effect transistor (FET), acting as a current sink 30, a current sense network 10, operational amplifier 20, and at least one light emitting diode 40. Of importance, VCLED 200 of FIG. 2 has a switch S1 connected between output terminal 26 of operational amplifier 20 and gate electrode 36 of FET 30. Switch S1 is controlled by a control signal SIC, generated by a control signal source (not shown) in order to selectively connect and disconnect output terminal 26 of operational amplifier 20 to and from gate electrode 36 of FET 30. In accordance, the control signal (VDAC) from variable voltage signal source provides light source brightness control, while switch S1 and associated control signal SIC provides control of gate electrode 36 inputs. The switchable nature of VCLED 200 supports modulated control of gate electrode 36 inputs and LED illumination whenever control signal SIC employs any one of a number of well known modulation techniques such as, for example, Amplitude Modulation (AM), Frequency Modulation (FM), Time Domain Modulation (TDM), or Pulse Width Modulation (PWM) for purposes of controlling S1 operation.

As will be appreciated by those skilled in the art, the "on-off" modulated control of switch S1 enables the VCLED 200 of FIG. 2 to exhibit rapid energize and de-energize cycle times; roughly on the order of 15-20 cycles per second. Since rapid "on-off" response is critical to the success of many high speed applications, the VCLED 200 of FIG. 2 is uniquely positioned as an LED drive circuit that supports both dynamic LED brightness control and high speed of operation.

Additionally, the modulated control of switch S1 enables the VCLED 200 of FIG. 2 to exhibit lower power consumption and superior heat performance when utilized in high current applications. Simply stated, turning high power LED 40 off when it is not needed, results in lower power consumption and less heat generation, both of which contribute to extended parts life and improved overall system efficiency. As previously mentioned, the VCLED 200 of the present invention is a relatively high powered device that operates in the 5-15 volt range and draws 2-20 Amps of current. As with most high power device applications, heat generation and dissipation becomes a recognizable concern. Pursuant to the present invention, it is desirable to increase the brightness of the LED 40. It is not; however, desirable to operate LED 40 in a high brightness mode for extended periods of time. The switch able nature of VCLED 200 nevertheless supports brightness control in both high power and high speed applications such as, for example, television and other motion picture image presentation devices employing LEDs as light sources.

FIG. 3 shows a digital micro-mirror (DMD) based image presentation device 300 that utilizes the drive circuitry 100 of FIG. 1 and alternatively, the drive circuitry 200 of FIG. 2. Only elements necessary for the understanding of the invention are shown since DMD based image projection systems are well known in the art. The image presentation device 300 is a rear projection television system, but can easily be a front projector or other micro-display based system. The device 300 utilizes red, green, and blue light emitting diodes (LEDs) 122,124,126 as light sources. A primary advantage associated with the light source selection of the preferred embodiment is reduced cost and complexity when compared to prior art systems that employ color wheels and various light filtration systems that are typically required to generate basic colors within the color spectrum. As shown, light sources 122, 124, 126 are individually controlled by respective LED drive circuits 100 of FIG. 1, or alternatively by LED drive circuit 200 of FIG. 2, in order to output light to optical combiner 130. The optical combiner is preferably formed from a combination of collimation lenses, condenser lenses, and dichroic prisms that together form part of a light engine for a DMD based system. Various configurations of light engines that may be used with the present invention are known in the art and will not therefore be described or discussed in further detail. The optical combiner is coupled to a prism 140 which redirects light output from the optical combiner 130 to a DMD panel device 150. The DMD panel device 150 comprises a large number of microscopic mirrors that, in conjunction with an image processing mode of operation, selectively reflect light through the prism 140 and onto projection optics 160 for display on a screen (not shown) for operator viewing. The DMD panel device 150 and light source controller 110 operate under the control of a controller 105 that manages both the image processing and non-image processing modes of operation of the device 300. Controller 105 is preferably a digital light processor (DLP) application specific integrated circuit (ASIC) which has, in the past, been commercially available from Texas Instruments corporation.

As shown, the DMD panel device 150 is also coupled to sensor 170. In conjunction with a non-image processing mode of operation, light being incident through the prism 140, but not being projected onto projection optics 160 is input to the sensor 170. In response, sensor 170 outputs a signal representing the output from the light emitting diodes 122,124,126. The sensor output is converted by Analog to Digital (A/D) converter 180 to a digital control signal and then fed to light source controller 110 for purposes of adjusting individual and/or collective light source inputs (VDAC) to respective LED drive circuits 100 or 200. As will be appreciated by those skilled in the art, sensor 170 is selected from the group of photo-sensors and photo-detection devices capable of outputting an electric signal that corresponds to various characteristics of light energy as generated by light source 122,124, 126. Characteristics of interest include, but are not limited to: light intensity, color accuracy, and color clarity. In accordance with the preferred embodiment, sensor 170 will employ a light intensity sensor, a photoelectric conversion device, a PIN diode, or any other such device capable of converting light energy into electric impulse for purpose of measurement and/or detection. In further accordance with the preferred embodiment, sensor 170 and A/D converter 180 may be combined into a single device commonly referred to as a light-to-digital (L/D) converter 190. In accordance with a preferred embodiment, the digital signal output from L/D converter 190 is input to the digital logic circuitry of light source controller 110, whereby luminance (i.e., light intensity) as measured in values of lux is derived using well known empirical formulas that approximate the human eye response. Light-to-digital converters of the type discussed herein have, in the past, been commercially available by contacting Texas Advanced Optoelectronics Solutions Inc. at their offices located at 800 Juniper Road, Suite 205 Plano, Tex. 75074.

As will be appreciated by those skilled in the art, over the life of a projection television system of the type anticipated by the present embodiment, variances in light source operating characteristics may have undesirable affect on the quality and the clarity of images produced by the image presentation device 300. By way of example, should, the operating characteristics of the individual LEDs 122, 124, 126, start to change or deteriorate over time, the color clarity, color accuracy, and picture quality of the images produced by image presentation device 300 will start to decline. It is therefore an advantage of present invention to controllably adjust the brightness of individual light sources 122, 124, 126 for purposes of maintaining a particular white light performance characteristic despite component aging or other conditions giving rise to variances in light source operation. In addition, it is an advantage of the present invention, to provide selective and dynamic LED brightness control in an image presentation device, such as the digital micro-mirror (DMD) based image presentation device 300 of FIG. 3.

As previously discussed, and with reference back to FIGS. 1 and 2, the non-inverting input terminal 24 of operational amplifier 20 is connected to a variable voltage signal source shown in FIG. 3 as light source controller 110. As will be appreciated by those skilled in the art, light source controller 110 may advantageously employ various digital logic circuitry, memory devices, and drive circuits of a type well known in the art for generating a variable voltage control signal VDAC for presentment to LED drive circuits 100 and 200 of FIGS. 1 and 2, for the purposes of dynamically controlling LED 122, 24, 126 brightness. Light source controller 110 is also capable of producing the modulated control signal S1C as utilized by switch S1 of FIG. 2. In accordance with a preferred embodiment, VDAC has a dynamic and variable voltage range that is selectable and most advantageously programmable by light source controller 110. When an increase in LED 122,124,126 brightness is desired, light source controller 110 will issue an increase in the magnitude of control signal VDAC, as applied to one or more of the drive circuits 100 associated with LED light sources 122, 124, 126. In response, the voltage at output terminal 26 of amplifier 20 for the selected drive circuit 100 will increase. When applied to gate electrode 36, the voltage increase will operate to turn-on FET 30. In further response, the resistance of FET 30 will decrease, while the magnitude of current ($i_{LED}$) passing through the LED in question will increase. As a function of the increase in current ($i_{LED}$) passing through the LED in question, LED brightness will increase.

When a decrease in LED 122, 124, 126 brightness is desired, light source controller 110, will issue a decrease in the magnitude of control signal VDAC, as applied to one or more of the drive circuits 100 associated with LED light sources 122,124,126. In response, the voltage at output terminal 26 of amplifier 20 for the selected drive circuit 100 will decrease. When applied to gate electrode 36, the voltage decrease will operate to turn-down FET 30. In further response, the resistance of FET 30 will increase, while the magnitude of current ($i_{LED}$) passing through LED in question will decrease. As a function of reduced current ($i_{LED}$) passing through LED in question, LED brightness will decrease.

As previously discussed, and with reference back to FIG. 2, switch S1 is connected to a control signal source shown in FIG. 3 as light source controller 110. Light source controller 110 may advantageously employ various digital logic circuitry, memory devices, and drive circuits of a type well known in the art for the purpose of generating a modulated control signal S1C of the type anticipated for use d by switch S1. As previously mentioned, light source controller 110 may use any of a number of well known modulation techniques such as, but not limited to, Amplitude Modulation (AM), Frequency Modulation (FM), Time Domain Modulation (TDM), or Pulse Width Modulation (PWM) for purposes of controlling S1 operation and ultimately for providing modulated control of LED light source illumination.

While preferred embodiments of the invention have been illustrated and described, it will be clear that the invention is not so limited. Numerous modifications, changes, variations, substitutions and equivalents will occur to those skilled in the art without departing from the spirit and scope of the invention as defined by the appended claims. By way of example, light source controller 110 may employ a reference voltage lookup table housing predetermined values, as a means of selecting a particular value of VDAC.

What is claimed is:

1. A voltage controlled light emitting diode (LED) having brightness control comprising:

a field effect transistor (FET) having source, gate, and drain electrodes;

a current sense network coupled to the source electrode of the FET;

an operational amplifier, having inverting and non-inverting input terminals, coupled between the source and gate electrodes of the FET;

a variable voltage signal source coupled to the non-inverting input terminal of the operational amplifier;

at least one light emitting diode (LED) coupled to the drain electrode of the FET; and wherein the operational amplifier receives a control signal (VDAC) from the variable voltage signal source for increasing and decreasing the brightness of the at least one LED as a function of control signal amplitude.

2. The voltage controlled light emitting diode (LED) of claim 1, wherein the drain electrode of the FET is coupled to a voltage supply through the at least one LED.

3. The voltage controlled light emitting diode (LED) of claim 1, wherein the control signal amplitude is independent of voltage supply values.

4. The voltage controlled light emitting diode (LED) of claim 1, wherein the FET utilizes N-channel transistor technology.

5. The voltage controlled light emitting diode (LED) of claim 1, wherein the current sense network comprises a voltage divider.

6. The voltage controlled light emitting diode (LED) of claim 5, wherein the current sense network is coupled to the inverting input terminal of the operational amplifier.

7. The voltage controlled light emitting diode (LED) of claim 1, wherein the control signal and the current flowing through the at least one LED exhibit a linear relationship.

8. The voltage controlled light emitting diode (LED) of claim 7, wherein LED brightness increases when the control signal amplitude increases.

9. The voltage controlled light emitting diode (LED) of claim 7, wherein LED brightness decreases when the control signal amplitude decreases.

10. A voltage controlled light source having brightness control comprising:

a field effect transistor (FET) having source, gate, and drain electrodes;

a current sense network connected to at least one electrode of the FET;

an operational amplifier, having inverting and non-inverting input terminals, coupled between the source and gate electrodes of the FET;

a variable voltage signal source coupled to the non-inverting input terminal of the operational amplifier;

a light source coupled to at least one electrode of the FET;

a switch disposed between the operational amplifier and the gate electrode of the FET; and wherein the operational amplifier continuously receives a control signal (VDAC) from the variable voltage signal source, while the switch provides control of gate electrode inputs.

11. The voltage controlled light source of claim 10, wherein the light source is a light emitting diode.

12. The voltage controlled light source of claim 10, wherein the control signal amplitude is derived independent of voltage supply values.

13. The voltage controlled light source of claim 10, wherein the switch provides pulsed control of gate electrode inputs.

14. The voltage controlled light source of claim 13, wherein the switch provides modulated control of light source illumination.

15. A voltage controlled light emitting diode (LED) having brightness control comprising:

a field effect transistor (FET) having source, gate, and drain electrodes;

a light emitting diode (LED) coupled to at least one electrode of the FET;

a feedback network, coupled to the gate electrode of the FET, and adapted to receive a control signal from a variable voltage signal source;

a switch, connected between the feedback network and the gate electrode of the FET; and wherein the switch provides control of gate electrode inputs, and LED brightness is altered as a function of control signal amplitude.

16. The voltage controlled light emitting diode (LED) of claim 15, wherein the feedback network comprises:

a difference amplifier, having inverting and non-inverting input terminals, coupled between the source and gate electrodes of the FET; and a voltage divider, connected to the source electrode of the FET and to the inverting input terminal of the difference amplifier.

17. The voltage controlled light emitting diode (LED) of claim 15, wherein the drain electrode of the FET is coupled to a voltage supply through the LED.

18. The voltage controlled light emitting diode (LED) of claim 15, wherein the control signal amplitude is independent of voltage supply values.

19. The voltage controlled light emitting diode (LED) of claim 15, wherein the control signal amplitude and the current flowing through the LED exhibit a linear relationship.

20. The voltage controlled light emitting diode (LED) of claim 15, wherein the switch provides modulated control of LED illumination.

21. An image presentation device having a light source with brightness control comprising:

a plurality of differing color light sources, each light source having a control signal input;

a light sensor positioned to receive light from the plurality of differing color light source and operable to provide an output characterizing the received light;

a controller coupled to the plurality of color light sources and to the sensor and responsive to output from the sensor to adjust the control signal input to at least one of the plurality of differing color light sources; and a light source drive circuit, coupled between the controller and the plurality of differing color light sources comprising:

a field effect transistor (FET) having source, gate, and drain electrodes;

at least one of the plurality of differing color light source coupled to at least one electrode of the FET;

a feedback network, coupled to the gate electrode of the FET, and adapted to receive the control signal input from the controller;

a switch, connected between the feedback network and the gate electrode of the FET; and wherein the switch provides control of gate electrode inputs, while light source brightness is altered as a function of control signal amplitude.

22. An image presentation device having a light source with brightness control comprising:

a plurality of differing color light sources, each light source having a control signal input;

a reference voltage look-up table providing information characterizing brightness settings for the plurality of differing color light sources;

a controller coupled to the plurality of color light sources and to the reference voltage look-up table and responsive to output from the reference voltage look-up table to adjust the control signal input to at least one of the plurality of differing color light sources;

a light source drive circuit, coupled between the controller and the plurality of differing color light sources comprising:

a field effect transistor (FET) having source, gate, and drain electrodes;

at least one of the plurality of differing color light source coupled to at least one electrode of the FET;

a feedback network, coupled to the gate electrode of the FET, and adapted to receive the control signal input from the controller;

a switch, connected between the feedback network and the gate electrode of the FET; and wherein the switch provides modulated control of gate electrode inputs, while light source brightness is altered as a function of control signal amplitude.

* * * * *